US006634899B2

(12) United States Patent
Takahiro et al.

(10) Patent No.: US 6,634,899 B2
(45) Date of Patent: Oct. 21, 2003

(54) CARD EDGE CONNECTOR

(75) Inventors: Kawamae Takahiro, Kanagawa (JP); Katsuhiko Kobayashi, Yamanashi (JP); Tadahiro Fumikura, Chiba (JP)

(73) Assignee: Tyco Electronics, AMP, K.K., Kanagawa (JP)

( * ) Notice: Subject to any disclaimer, the term of this patent is extended or adjusted under 35 U.S.C. 154(b) by 0 days.

(21) Appl. No.: 10/024,882

(22) Filed: Dec. 19, 2001

(65) Prior Publication Data

US 2002/0081885 A1 Jun. 27, 2002

(30) Foreign Application Priority Data

Dec. 21, 2000 (JP) ..... 2000-388145

(51) Int. Cl.[7] ..... H01R 13/62
(52) U.S. Cl. ..... 439/328
(58) Field of Search ..... 439/328, 326, 439/629

(56) References Cited

U.S. PATENT DOCUMENTS 5,766,031 A * 6/1998 Yeh ..... 439/328
6,126,472 A * 10/2000 Choy ..... 439/328
6,176,725 B1 * 1/2001 Kobayashi et al. ..... 439/326

FOREIGN PATENT DOCUMENTS

JP 08190967 A 7/1996 ..... H01R/23/00
JP 2000208183 A 7/2000 ..... H01R/12/16

* cited by examiner

*Primary Examiner*—Renee Luebke
*Assistant Examiner*—Ann McCamey
(74) *Attorney, Agent, or Firm*—Barley, Snyder, Senft & Cohen, LLC

(57) ABSTRACT

A card edge connector 1 capable of effectively restraining a daughter board B from inadvertent removal in the horizontal direction by increasing the holding pressure of the daughter board B. The card edge connector 1 has an insulated housing 10 mounted onto the mother board A and latch members 30A, 30B attached to the housing 10, for holding the daughter board B. The latch members 30A, 30B have a daughter board locking portion 47*a* for restraining the daughter board B in the horizontal direction. The locking portion engages the inner wall of the semicircular recess B1 formed at the edge portion of the daughter board B. The daughter board locking portion 47*a* has a pointed edge portion 47*c* for penetrating the inner wall of the semicircular recess B1.

18 Claims, 9 Drawing Sheets

CARD EDGE CONNECTOR

FIELD OF THE INVENTION

The present invention relates to a card edge connector, and more specifically to a card edge connector mounted onto a mother board having a detachably connected daughter board.

DESCRIPTION OF THE PRIOR ART

Card edge connectors, such as those commonly used in personal computers or the like, are mounted on a mother board and have a daughter board such as Single Inline Memory Module (SIMM) or Double Inline Memory Module (DIMM) detachably connected. An example of one such connector is shown in FIG. 9 (see Japanese Patent Laid-Open No. 8-190967).

This card edge connector 101, as shown in FIG. 9A, has an insulated housing 110 mounted on a mother board (not shown). The housing has two daughter board receiving recesses 111, 211 extending in the longitudinal direction. A plurality of contacts 121, 221 is attached in two upper and lower rows along the longitudinal direction of the daughter board receiving recesses 111, 211 and are connected to the mother board. At both ends of the daughter board receiving recess 111 of the housing 110 are latch portions 131 for holding a daughter board 300 that has been placed in a horizontal position by being rotated after being obliquely inserted into the daughter board receiving recess 111, at a horizontal angle. Similarly, at both ends of the daughter board receiving recess 211 are latch portions 231 for holding the daughter board 300 that has been placed at a horizontal angle by being rotated after being obliquely inserted into the daughter board receiving recess 211, at a horizontal angle.

Each latch portion 131, 231 is formed integrally with the housing 110. At the front end of the latch portion (right end in FIG. 9B), there are provided restraining portions 132, 232 and daughter board locking portions 133, 233. Each of the restraining portions 132, 232 projects inwardly from the top part of the front end of the latch portion 131, 231. When the daughter board 300 is inserted into the daughter board receiving recess 111, 211 and rotated to a horizontal position from an oblique position, each of the restraining portions 132, 232 is resiliently displaced away from the board and is then returned to its original or unstressed state by means of an elastic force of the latch portions 131, 231. In the unstressed position, the restraining portions 132, 232 come into contact with the top surface of the edge portion of the daughter board 300 to prevent the daughter board 300 from being inadvertently rotated from the horizontal position. Each of the daughter board locking portions 133, 233 projects, as shown in FIG. 9B (in FIG. 9B only the daughter board locking portion 133 is shown), inwardly from a position adjacent to the restraining portion 132, 232 of the latch portion 131, 231. When the daughter board 300 is placed in a horizontal position with respect to the mother board, each of the daughter board locking portions 133, 233 enters a semicircular recess 301 formed at the edge portion of the daughter board 300. When a force is applied to the daughter board 300 in the horizontal direction (direction indicated by an arrow in FIG. 9B), press surfaces 133A, 233A (only 133A is shown) thereof act so as to press an abutting surface 301A formed on the inner wall of the semicircular recess 301, preventing the daughter board 300 from being removed from the connector 101 in the horizontal direction.

While the prior art connector described above maintains the board in position when fully inserted into the connector 101, it is not difficult to overcome the locking portions. Therefore, it is likely that the daughter board will disengage from the connector due to an impact such as falling, which is unacceptable in many applications.

SUMMARY OF THE INVENTION

An object of the present invention is to provide a card edge connector capable of effectively restraining a daughter board from disengaging from a conductor in the horizontal direction even under adverse conditions by increasing the holding pressure applied by a latch member to the daughter board. The card edge connector of the present invention has an insulated housing mounted onto a mother board and a latch member attached to the housing for holding the daughter board. The latch member has a daughter board locking portion for restraining the daughter board from inadvertent removal in the horizontal direction. The latch member engages with an inner wall of a semicircular recess formed at an edge portion of the daughter board. The daughter board locking portion has a pointed edge portion that cooperates with the inner wall of the semicircular recess to maintain the daughter board in position.

In the embodiment, the latch member is a metal latch which is stamped and formed from a metal plate. The pointed edge portion is a burr edge provided at a tip end of the latch member that is formed when the metal plate is stamped. The pointed edge portion is inclined in a direction perpendicular to the horizontal direction, and enters in the vicinity of a top end of the inner wall of the semicircular recess.

BRIEF DESCRIPTION OF THE DRAWINGS

FIG. 1A is a plan view, FIG. 1B is a front view, and FIG. 1C is a right side view showing both a mother board and a daughter board;

FIG. 2A is a front view showing a partial section, FIG. 2B is a right side view, and FIG. 2C is a left side view;

FIG. 4A is an explanatory view for illustrating a state of the daughter board locking piece entering in a semicircular recess as viewed from the plane side, and FIG. 4B is an explanatory view for illustrating a state of the daughter board locking piece entering in a semicircular recess as viewed from the right side. In FIG. 4B, the daughter board is indicated by an alternate long and short dash line;

FIG. 5A is a plan view, FIG. 5B is a front view, FIG. 5C is a left side view, FIG. 5D is a bottom view, and FIG. 5E is a sectional view taken along line 5E—5E of FIG. 5A;

FIG. 7A is a right side view, FIG. 7B is a plan view, and FIG. 7C is a partial enlarged view when the daughter board holding portion is viewed from the bottom side;

FIG. 8A is an explanatory view for illustrating a state of the daughter board locking piece entering in a semicircular recess as viewed from the plane side, and FIG. 8B is an explanatory view for illustrating a state of the daughter board locking piece entering in a semicircular recess as viewed from the right side. In FIG. 8B, the daughter board is indicated by an alternate long and short dash line; FIG. 9A is a partial perspective view, and FIG. 9B is a partial perspective view showing detailed structure of the upper portion of a side wall of the upper-stage housing portion. In this respect, in FIG. 9B, a part of the daughter board is shown together.

DETAILED DESCRIPTION OF THE INVENTION

Figures 1A, 1B, 1C:
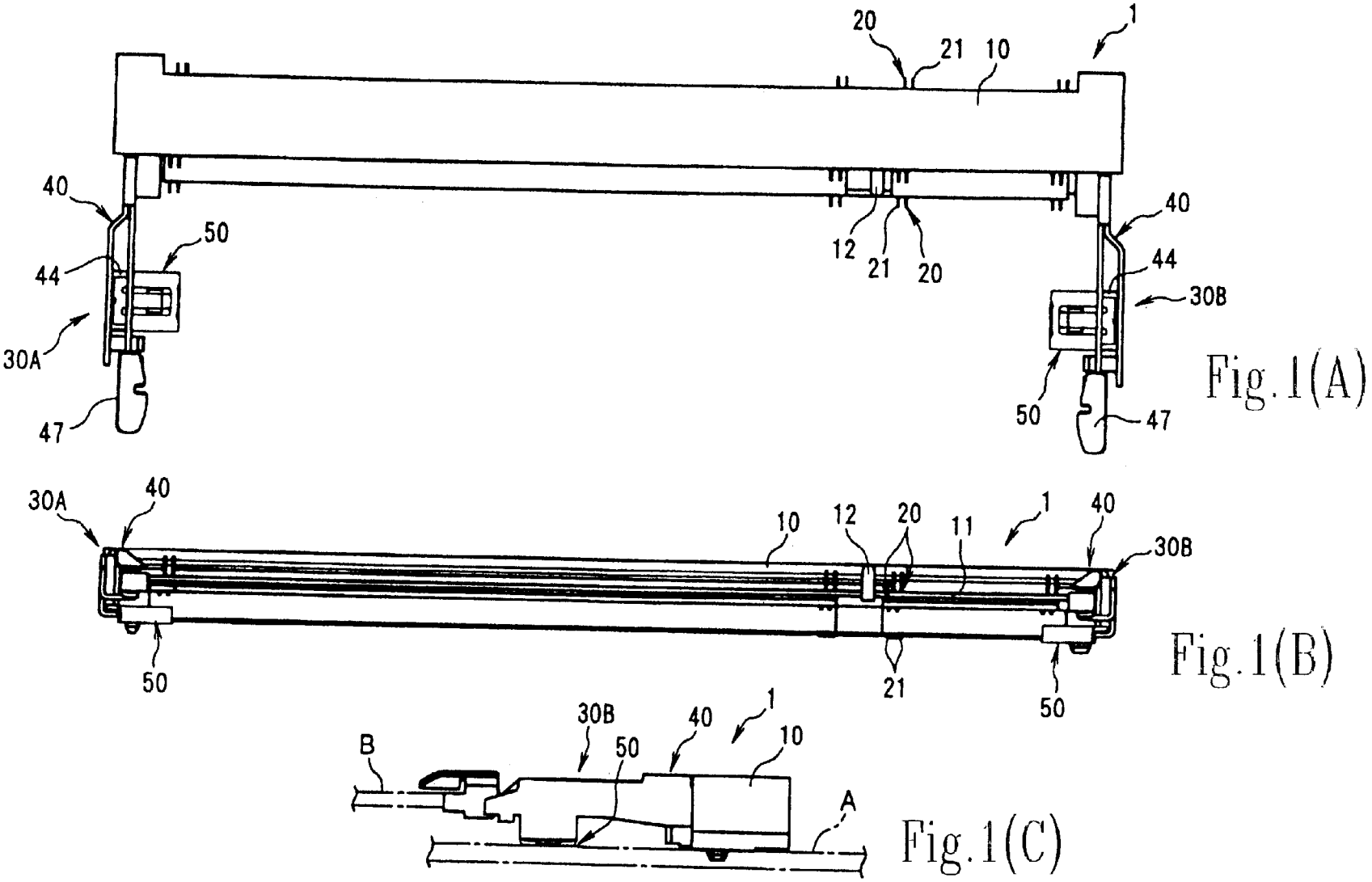
FIGS. 1A to 1C show a card edge connector according to a first embodiment of the present invention.

In FIG. 1, a card edge connector 1 has an insulated housing 10 mounted on a mother board A. A daughter board receiving recess 11 is provided on the housing 10 and extends in the longitudinal direction (left and right direction in FIG. 1B). A plurality of contacts 20 are arranged in a two-upper and lower rows which extend in the longitudinal direction of the housing 10 and along the daughter board receiving recess 11. Each contact 20 has a soldering portion 21 to be surface mounted on the mother board A using conventional solder or the like. At both longitudinal ends of the housing 10, there are provided latch members 30A, 30B. The latch members are configured to cooperate with and maintain, at a second angle (horizontal angle with respect to the mother board A), a daughter board B. The daughter board B has been placed at the second angle by being rotated after inserted at a first angle (an oblique angle with respect to the mother board A) within the daughter board receiving recess 11. When the daughter board B is received at the first angle within the daughter board receiving recess 11, the daughter board B is received between the plurality of contacts 20 arranged in the two upper and lower rows. When it is rotated to be held at the second angle, the daughter board B comes into contact with the two upper and lower rows of contacts 20, whereby the daughter board B is electrically connected to the mother board A.

In the embodiment shown, the housing 10 is an insulating member having a substantially rectangular body extending in the longitudinal direction, and is formed by molding synthetic resin such as PBT. Offset from the longitudinal center to the right side (right side in FIG. 1B) of the center of the housing 10 is a rib 12 for preventing the daughter board B from being inserted improperly. The rib 12 cooperates with a respective slot in the daughter board B to provide the keying necessary to insure that the daughter board B can only be properly inserted into the housing 10.

A pair of latch members 30A, 30B symmetrical in shape are formed about the center of the housing 10 in the longitudinal direction. A left-side latch member 30A is arranged on the left side with respect to the center and a right-side latch member 30B is arranged on the right side with respect to the center. Since the left-side latch member 30A and the right-side latch member 30B are symmetrical in shape, only the structure of the left-side latch member 30A will be described hereinafter, and the description of structure of the right-side latch member 30B will be omitted.

Figure 2A:
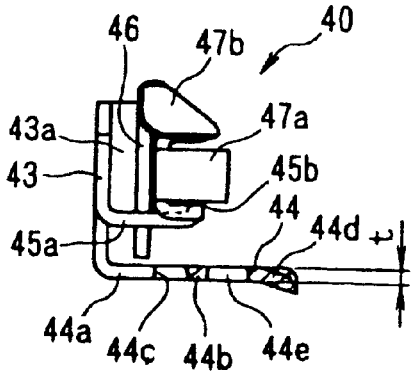
FIGS. 2A to 2C show a latch body constituting a left-side latch member to be used for the card edge connector shown in FIG. 1
Figure 2B:
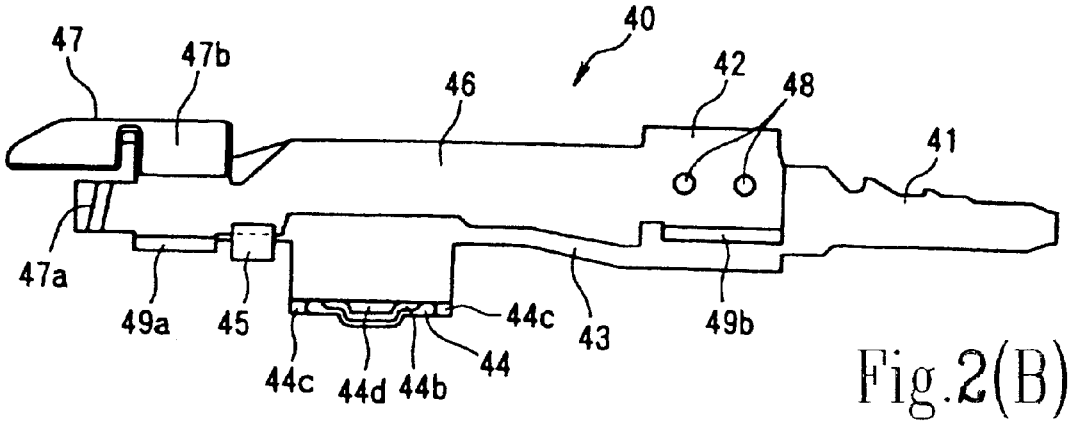
Figure 2C:
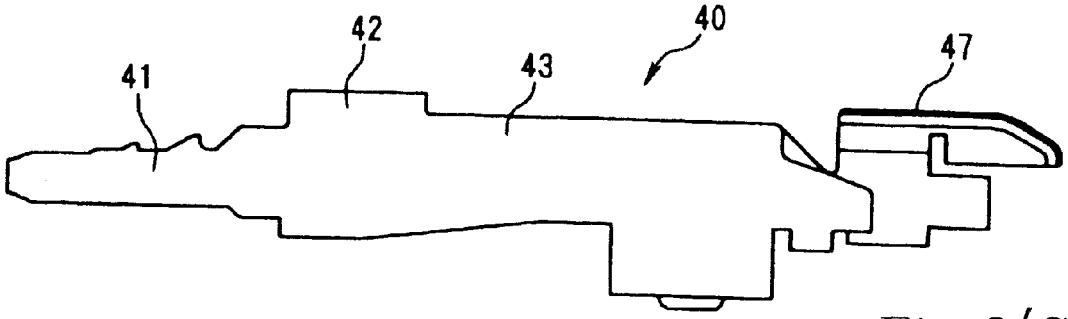

As shown in FIG. 1, the left-side latch member 30A has a metallic latch body 40 and a metallic fixing member 50 separate from the latch body 40. In the embodiment shown, the latch body 40 is a metal latch stamped and formed from a metal plate such as stainless steel. The latch body has a press fitted plate portion 41 that is press fitted in the housing 10, shown in FIGS. 2 and 3. At the front end (lower end in FIG. 3) of the press fitted plate portion 41, a transition portion 43*a* extends obliquely forward toward the outside. A first flat plate portion 43 extends forward from the tip end of the transition portion 43*a*. At the upper edge of the front end of the press fitted plate portion 41, a folded piece 42 is provided that is folded back downward and inward after extending upwardly once. At the front edge of the folded piece 42, a second flat plate portion 46 is provided that extends forward substantially parallel to the first flat plate portion 43. A plurality of projections 48 are provided on the outer surface of the folded piece 42. The projections 48 project outwardly to maintain the distance between the first flat plate portion 43 and the second flat plate portion 46 at a predetermined distance.

At the front end of the second flat plate portion 46 is a daughter board holder 47 for holding the daughter board B at the second angle. The daughter board holder 47 has a daughter board locking piece or daughter board locking portion 47*a* that is bent from the front end of the second flat plate portion 46. The daughter board locking portion 47*a* is bent at a predetermined angle. A daughter board holding piece 47*b* is bent from the top edge thereof inwardly. When the daughter board B is inserted within the daughter board receiving recess 11 at the first angle and rotated to the second angle, the daughter board holding piece 47*b* is resiliently deformed to the outside. With the daughter board B properly placed at the second angle, the daughter board holding piece 47*b* is returned to its unstressed position by the elastic force of the second flat plate portion 46. As the daughter board holding piece 47*b* returns, it comes into contact with the top surface of the edge portion of the daughter board B to prevent the daughter board B from rotating back to the first angle or initial insertion position.

Figure 4A:
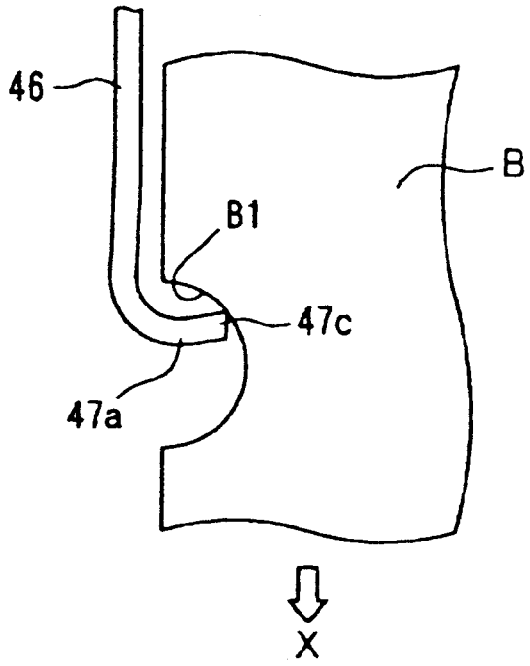
FIGS. 4A to 4B are explanatory views for illustrating the cooperation of the locking member of the latch body shown in FIG. 2 with the daughter board.
Figure 4B:
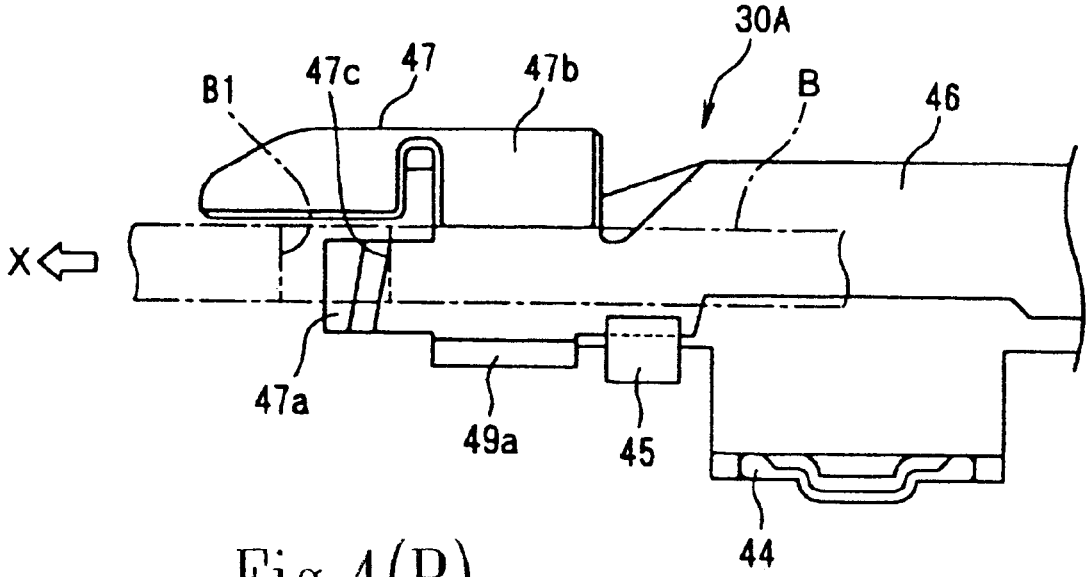
Figure 5A:
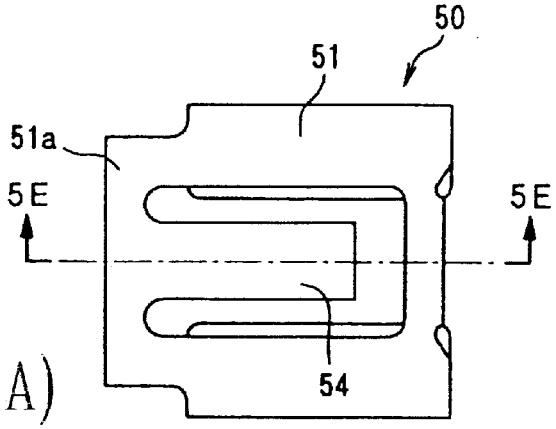
FIGS. 5A to 5E show a fixing member constituting a left-side latch member to be used for the card edge connector shown in FIG. 1
Figure 5B:
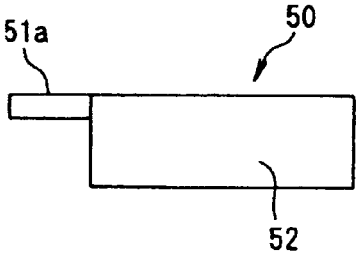
Figure 5C:
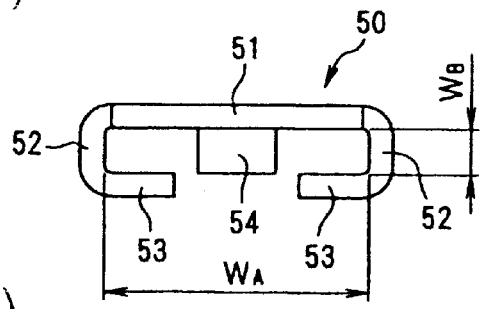
Figure 5E:
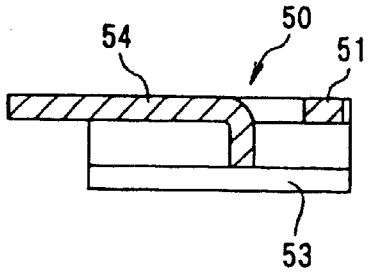
Figure 5D:
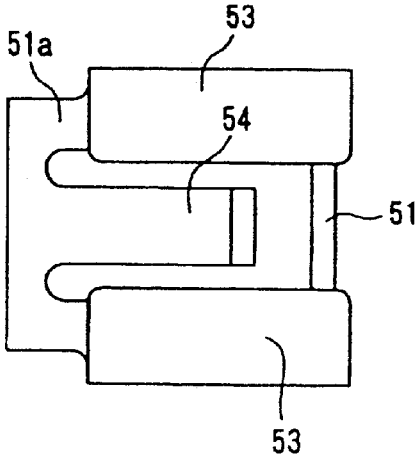

As shown in FIG. 4, the daughter board locking piece 47*a* is provided in a semicircular recess B1 formed at the edge portion of the daughter board B. When the daughter board B is positioned at the second angle and a removal force is applied to the daughter board B in the horizontal direction forward (direction indicated by an arrow X shown in FIGS. 4A and 4B), the daughter board locking piece 47*a* engages with the inner wall of the semicircular recess B1 to prevent the daughter board B from being inadvertently removed from the connector 1 in the horizontal direction. A top end of a pointed edge portion 47*c* is formed on the inner part (upper side in FIG. 4A) of the tip end of the daughter board locking piece 47*a*, which inclines along an up-and-down direction perpendicular to the horizontal direction. When a force is applied to the daughter board B in the horizontal direction indicated by arrow X of FIGS. 4A and 4B, the top end of the pointed edge portion 47*c* comes into point-contact with the vicinity of the top end of the inner wall of the semicircular recess B1 and digs therein as shown in FIG. 4B. For this reason, the holding pressure of the daughter board B due to the daughter board locking piece 47*a* of the latch member 40 can be considerably increased over the prior art.

The daughter board B is thereby retained in the connector 1 and inadvertent removal in the horizontal direction is effectively eliminated. Since the pointed edge portion 47*c* is inclined or bent back toward the housing 10, as shown in FIG. 4A, the locking piece 47*a* not only prevents the daughter board B from being inadvertently removed, the bent edge portion 47*c* exerts a force on the daughter board B in a direction toward the housing 10 to insure that the daughter board B is properly positioned. This force is generated by the resilient nature of locking piece 47*a* and edge portion 47*c,* which causes each to return toward an unstressed position. In this respect, the pointed edge portion 47*c* is not limited to a case where it is formed in the inner part of the tip end of the daughter board locking piece 47*a,* but may be formed, for example, by the edge of a tongue piece raised from the middle of the daughter board locking piece 47*a.* In the embodiment shown, the pointed edge portion 47*c* is preferably constituted by a burr edge to be formed when a metal plate is stamped. By utilizing the burr edge, the edge may more easily penetrate the inner wall of the semicircular recess B1, so that the holding pressure of the daughter board B due to the daughter board locking piece 47*a* can be further increased. In another embodiment, the pointed edge portion 47*c* may be parallel with plate 46. In this case, edge portion 47*c* would be offset from plate 46 such that when a force is applied to the daughter board B in the horizontal direction, the pointed edge portion 47*c* comes into line-contact and pierces or penetrates the inner wall of the semicircular recess B1. The holding pressure of the daughter board B of this embodiment can be increased when compared to the holding pressure of the daughter board B obtained by conventional area-contact.

At both the lower edge of the front end and the lower edge of the rear end of the second flat plate portion 46 are daughter board supporting portions 49*a,* 49*b* that extend to the inner part for supporting the daughter board B from the lower side when the daughter board B is positioned at the second angle. The daughter board supporting portions 49*a,* 49*b* are formed so as to be on different levels in such a manner that positions of their top surfaces, in the direction of height, do not coincide with each other, so that any warp of the daughter board B when the daughter board B is positioned at the second angle has been taken in consideration.

Figure 3:
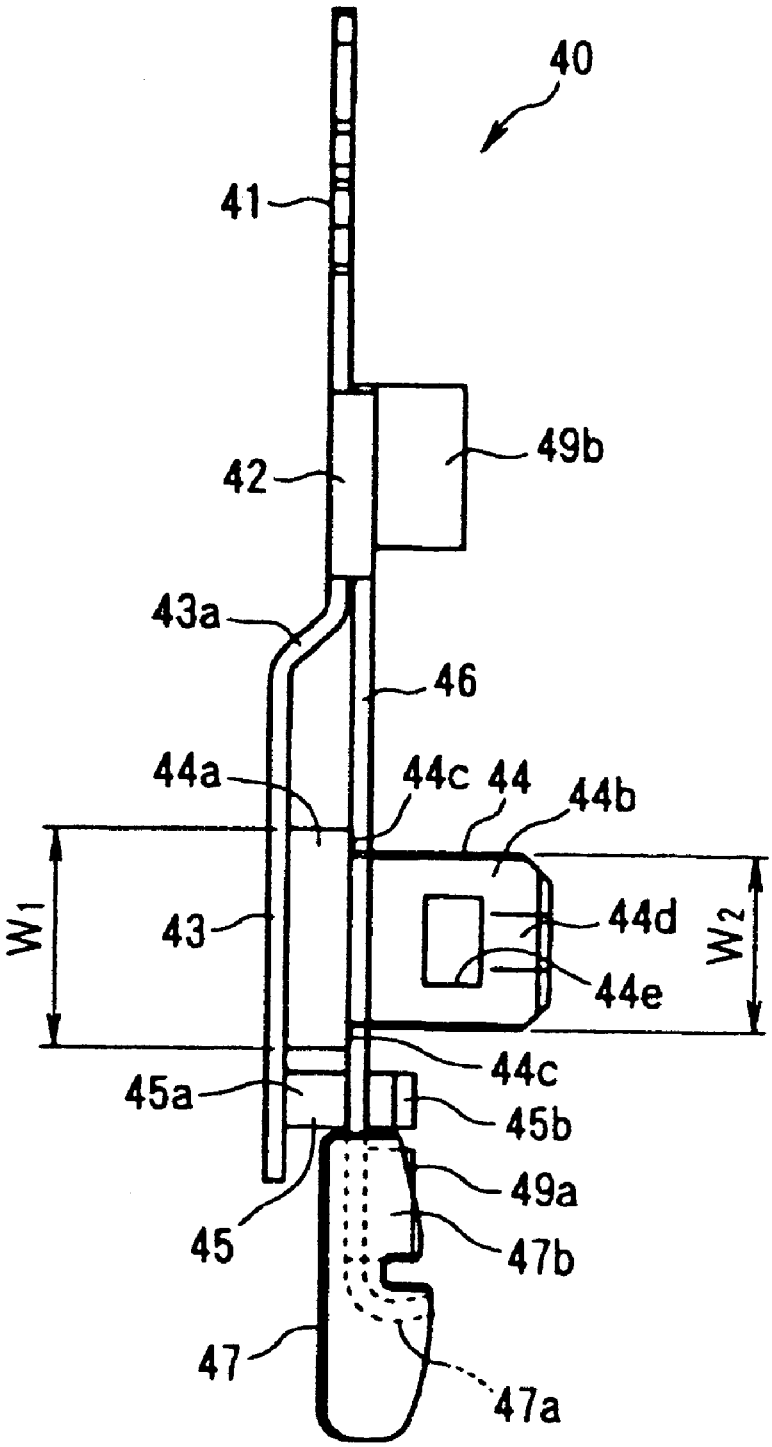
FIG. 3 is a plan view showing the latch body shown in FIG. 2.
Figure 6:
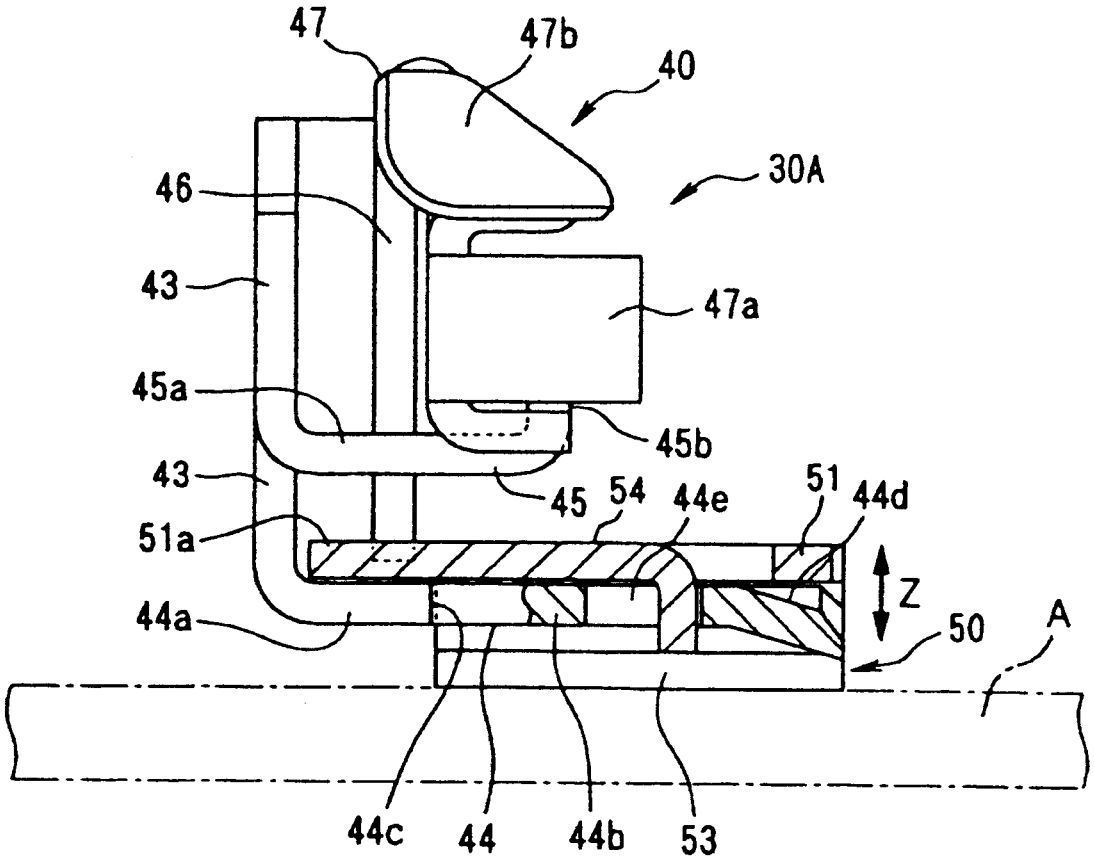
FIG. 6 is a front view showing a partial section of a fixing member of the left-side latch member which has been connected to the mother board by soldering.

From the lower edge of the first flat plate portion 43, at a central portion thereof, a tab 44 with plate thickness t is bent inward. The tab 44 extends below the second flat plate portion 46. The tab 44 has a broad portion 44*a* having relatively broad width, bent inward from the first flat plate portion 43, and a narrow portion 44*b* extending inward from the tip end of the broad portion 44*a,* having narrower width than the broad portion 44*a.* In FIG. 3, width $W_2$ of the narrow portion 44*b* is narrower than width $W_1$ of the broad portion 44*a.* Thus, as shown in FIGS. 3 and 6, on the tip end edge surface of the broad portion 44*a* located on both sides of the narrow portion 44*b,* there are formed restraining shoulders 44*c.* A restraining aperture 44*e* is provided in the narrow portion 44*b* of the tab 44. At the tip end of the narrow portion 44*b,* there is formed an inclined surface 44*d* with a pre-determined width that obliquely upwardly inclines from the tip end of the narrow portion 44*b* toward the restraining aperture 44*e.* A stabilization piece 45 with a connecting portion 45*a,* is bent inward from the lower edge of the front end of the first flat plate portion 43 and is located below the second flat plate portion 46. A stand-up piece 45*b* extends from the tip end of the connecting portion 45*a* in a direction essentially perpendicular to the connecting portion. The second flat plate portion 46 is arranged so as to be located between the first flat plate portion 43 and the stand-up piece 45*b,* such that any movement of the second flat plate portion 46 toward the outside is restricted by the first flat plate portion 43 while any movement of the second flat plate portion 46 toward the inside is restricted by the stand-up piece 45*b.*

A fixing member 50, as shown in FIG. 5, is stamped and formed from a metal plate such as stainless steel and copper alloy. A flat plate top portion 51 extends in a bending direction of the tab 44. A pair of side plate portions 52 extend downward from both sides of the flat plate top portion 51. A pair of flat plate bottom portion portions 53 extend from each of the lower ends of the pair of side plate portions 52 toward each other. The fixing member 50 is soldered or tinned in order to be soldered in position.

A guide plate 51*a* is provided at the left end of the flat plate top portion 51. A cantilever-shaped elastic restraining piece 54 extends from the left end side of the flat plate top portion 51 toward the right end side along a bending direction of the tab 44. The elastic restraining piece 54 has a slightly smaller width than the width of the inclined surface 44*d* of the tab 44. The tip end of the elastic restraining piece 54 is bent downward until it reaches a surface substantially flush with the top surface of the flat plate bottom portion 53 in a free state. The width $W_A$ between a pair of side plate portions 52 is slightly larger than the width $W_2$ of the narrow portion 44*b* of the tab 44. The width $W_B$ between the pair of flat plate bottom portion portions 53 and the flat plate top portion 51 is larger than the plate thickness t of the tab 44.

As shown in FIG. 6, the fixing member 50 is pressed toward the first flat plate portion 43 of the latch body 40. In this position, the guide plate 51*a* of the flat plate top portion 51 is engaged proximate to the top surface of the narrow portion 44*b* of the tab 44, whereby the fixing member 50 is mounted to the tab 44 of the latch body 40. At the time of this mounting, within space of the fixing member 50 to be enclosed with the flat plate top portion 51, the pair of side plate portions 52 and the pair of flat plate bottom portions 53, the narrow portion 44*b* of the tab 44 is inserted from the tip end. The guide plate 5l*a* runs along the top surface of the narrow portion 44*b* of the tab 44, whereby the narrow portion 44*b* can be easily inserted. When the narrow portion 44*b* of the tab 44 is inserted within the space of the fixing member 50 from the tip end thereof, the tip end of the elastic restraining piece 54 of the fixing member 50 slides on an inclined surface 44*d* formed at the tip end of the narrow portion 44*b* to bend the elastic restraining piece 54 upward. Thus, when the tip end of the elastic restraining piece 54 reaches the restraining aperture 44*e,* the elastic restraining piece 54 returns to its original or unstressed position to enter the restraining aperture 44*e,* and engages with the edge of the restraining aperture 44*e.* The left edge surface of the side plate portions 52 in the tab bending direction abuts a restraining shoulder 44*c* formed at the tab 44. Since the tip end of the elastic restraining piece 54 is adapted to slide on the inclined surface 44*d* when the elastic restraining piece 54 engages with the restraining aperture 44*e,* the tip end of the elastic restraining piece 54 is smoothly guided into the restraining aperture 44*e.* The elastic restraining piece 54 is engaged with the restraining aperture 44*e,* and the left edge surface of the side plate portions 52 in the tab bending direction abuts against a restraining shoulder 44*c* formed at the tab 44, whereby any movement of the fixing member 50 in the tab bending direction is restricted. The inner surfaces of the pair of side plate portions 52 abut the side edge of the narrow portion 44*b* of the tab 44, whereby any movement of the fixing member 50 in a direction perpendicular to the tab bending direction is restricted at the same time. Thus, after the fixing member 50 is mounted onto the tab 44, the fixing member 50 is capable of moving in the up-and-down direction (z-direction in FIG. 6), but the lower surface of the flat plate top portion 51 of the fixing member 50 abuts the top surface of the narrow portion 44*b,* whereby the movement of the fixing member 50 in the lower direction is restricted, and the top surface of the flat plate bottom portion 53 abuts the lower surface of the narrow portion 44*b,* whereby the movement of the fixing member 50 in the upper direction is restricted.

By attaching a pair of left and right latch members 30A, 30B to both ends of the housing 10, to which a plurality of contacts 20 have been attached, in the longitudinal direction, the card edge connector 1 is completed. Thereafter, the card edge connector 1 is surface mounted onto the mother board A, and is arranged in the interior of a personal computer or the like.

When mounting the card edge connector 1 onto the mother board A, after a soldering portion 21 of the contact 20 and a flat plate bottom portion 53 of the fixing members 50, 50 of the latch members 30A, 30B are arranged at the predetermined positions on the mother board A, as shown in FIGS. 1C and 6, reflow soldering will be performed. Thereby, the card edge connector 1 is mounted onto the mother board A.

Since at this time, the fixing member 50 is movable within a certain range in the up-and-down direction (direction z in FIG. 6) with respect to the tab 44 of the latch body 40, even if the mother board A has been warped, the warp can be absorbed by moving the fixing member 50 up or down accordingly, and the soldering portion 21 of the contact 20 and the fixing member 50 can be favorably solder onto the mother board A.

Figure 7A:
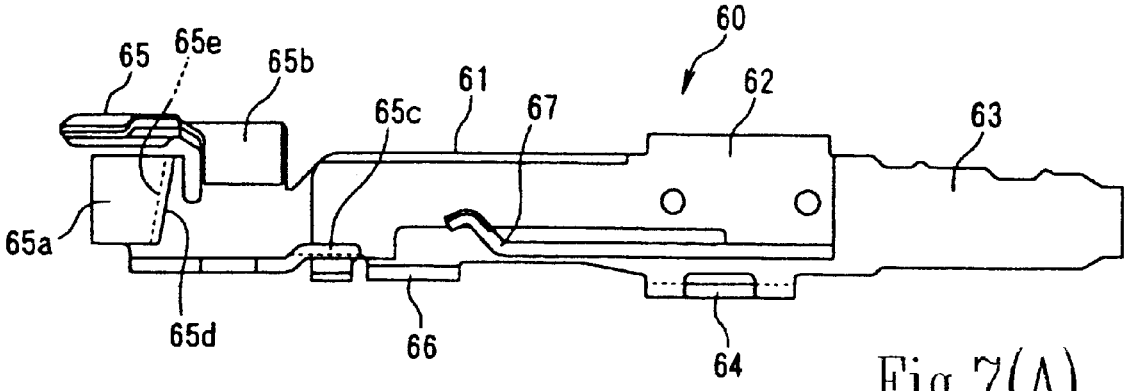
FIG. 7A to FIG. 7C show a left-side latch member to be used with the second embodiment of the card edge connector according to the present invention.
Figure 7B:
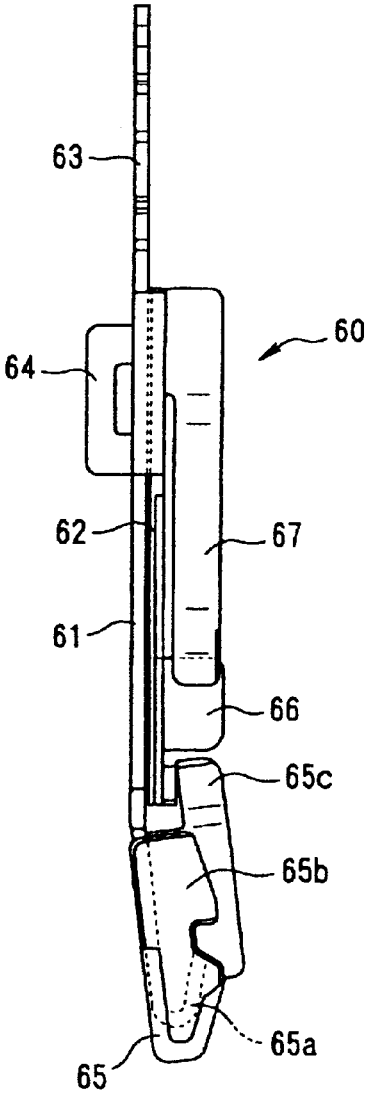
Figure 7C:
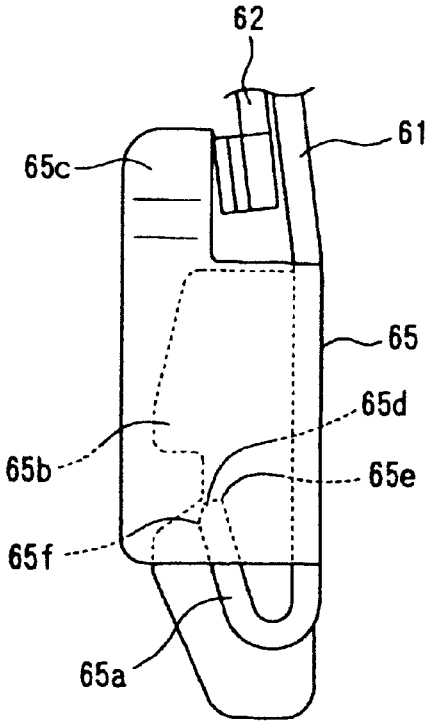

With reference to FIGS. 7 and 8, an alternate or second embodiment according to the present invention will be described. The second embodiment of a card edge connector according to the present invention has a substantially similar structure to the card edge connector 1 of the first embodiment shown in FIG. 1; however, the pair of left-side and right-side latch members for holding the daughter board B have a different structure. Since the left-side latch member and the right-side latch member that constitute the pair of latch members, are symmetrical in shape, only the structure of the left-side latch member will be described hereinafter, and description of the right-side latch member will be omitted.

As shown in FIG. 7, the left-side latch member 60 is a metal latch stamped and formed from a metal plate such as stainless steel. The latch member 60 has two flat plate portions 61, 62 placed on top of each other. Of these flat plate portions 61, 62, the flat plate portion 61 on the outside (left side in FIG. 7B) is provided with a press fitted plate portion 63 located at the rear end (top end in FIG. 7B), a fixing portion 64 bent outward from the lower end, a daughter board holder 65 located at the front end, and an anti-over stress piece 66 bent inward from the lower end. Each press fitted plate portion 63 is press fitted into a respective end of the housing (not shown). The fixing portion 64 is soldered to a grounding pattern on the mother board A. The flat plate portions 61, 62, the flat plate portion 62 on the inside is provided with an elastic contact piece 67 bent inward from the lower end, for extending forward. When the daughter board B has been rotated and placed at the second angle (horizontal angle with respect to the mother board A) after inserted at the first angle (an oblique angle with respect to the mother board A), this elastic contact piece 67 engages with a grounding pattern formed on the lower surface of the daughter board B causing the daughter board B to ground the mother board A through the fixing portion 64.

The daughter board holder 65 is provided on the outside of the flat plate portion 61 to hold the daughter board B at the second angle. A daughter board locking piece or daughter board locking portion 65*a* is bent from the flat plate portion 61 inward from the front end. The angle at which the daughter board locking portion 65*a* is bent is larger than the angle at which the daughter board locking piece 47*a* is bent. A daughter board holding piece 65*b* is bent from the flat plate portion 61 inward from the top edge. An excessive movement preventing piece 65*c* is also provided.

When the daughter board B is inserted into the daughter board receiving recess (not shown) of the housing 10 at the first angle and rotated to the second angle, the daughter board holding piece 65*b* initially moves to the outside and then returns to its original, unstressed position due to an elastic force of the flat plate portion 61. The daughter board holding piece 65*b* comes into contact with the top surface of the edge portion of the daughter board B to prevent the daughter board B from being inadvertently removed from the connector.

Figure 8A:
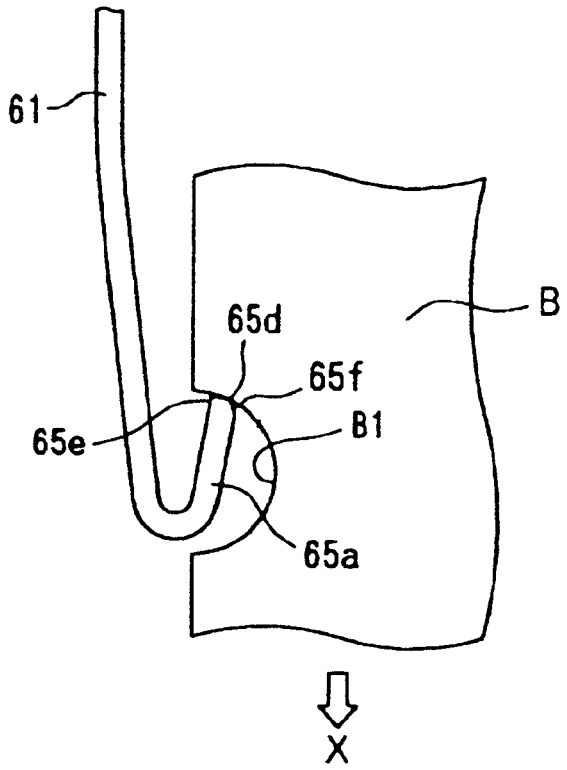
FIGS. 8A to 8B are explanatory views for illustrating the prevention of the daughter board from inadvertent removal by means of a daughter board locking piece of the latch member shown in FIG. 7.
Figure 8B:
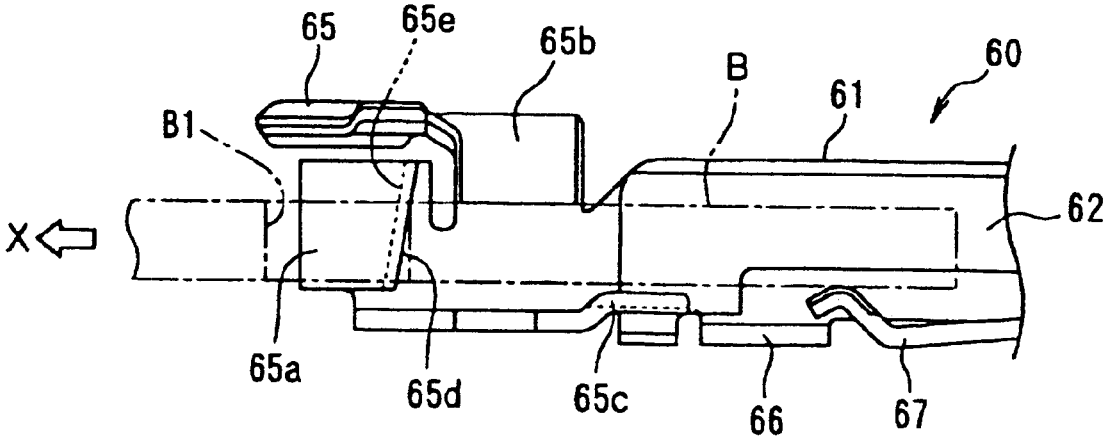
Figure 9A:
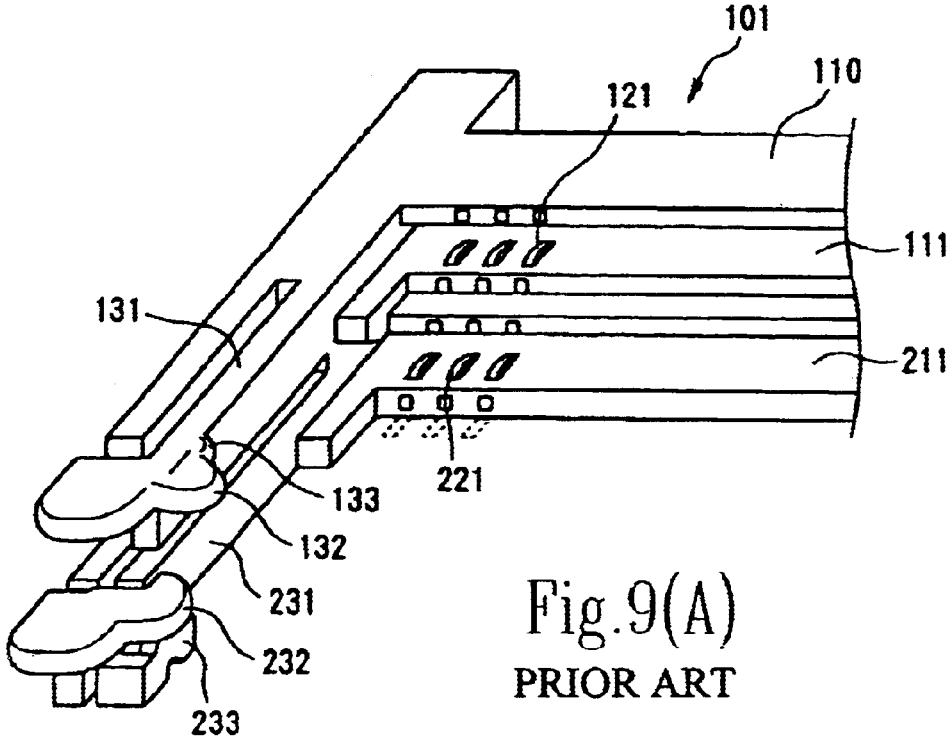
Fig.9(A) PRIOR ART
FIGS. 9A to 9B show a card edge connector according to a conventional example of the prior art.
Figure 9B:
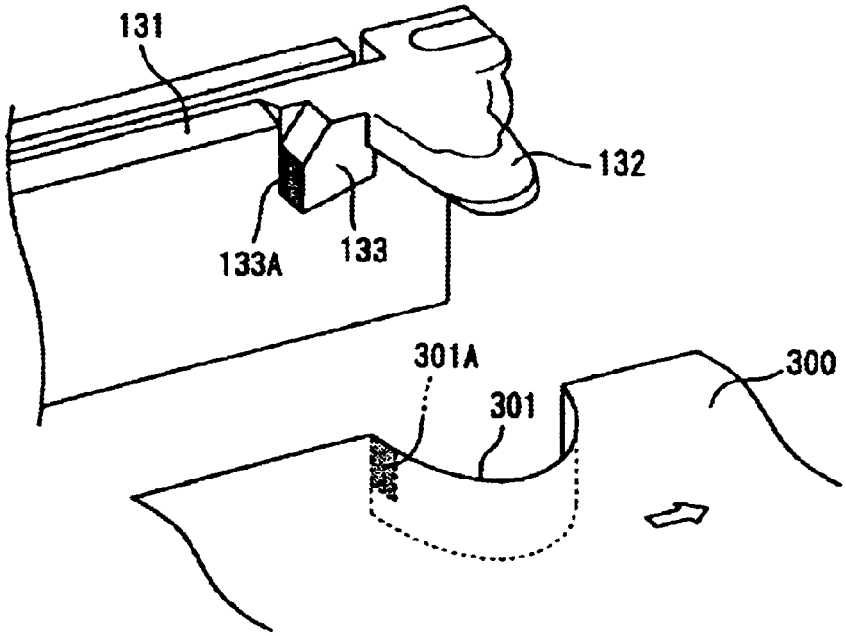
Fig.9(B) PRIOR ART

When the daughter board B is positioned at the second angle, the daughter board locking piece 65*a* enters, as shown in FIG. 8, the semicircular recess B1 formed at the edge portion of the daughter board B. When a force is applied to the daughter board B in the horizontal direction (a direction indicated by an arrow X in FIGS. 8A and 8B), the daughter board locking piece 65*a* engages with the inner wall of the semicircular recess B1 to prevent the daughter board B from being removed from the connector 1 in the horizontal direction. A portion of this daughter board locking piece 65*a* for engaging with the inner wall of the semicircular recess B1 is, as shown in FIGS. 8A and 8B, a pointed edge portion 65*d* formed on the outer part (right side in FIG. 8A) of the tip end of the daughter board locking piece 65*a*. Since the daughter board locking piece 65*a* has been bent inward from the front end of the flat plate portion 61 at a larger angle than the daughter board locking piece 47*a,* it becomes possible to cause a pointed edge portion 65*d* formed on the outside of the tip end of the daughter board locking piece 65*a* to engage with the inner wall of the semicircular recess B1. When a force is applied to the daughter board B in the horizontal direction, this pointed edge portion 65*d* comes into point-contact and penetrates the top end of the inner wall of the semicircular recess B1. For this reason, the holding pressure of the daughter board B due to the daughter board locking piece 65*a* of the latch member 60 can be considerably increased, and the inadvertent removal of the daughter board B in the horizontal direction can be effectively restrained. Since the pointed edge portion 65*d* has been inclined along the up-and-down direction perpendicular to the horizontal direction, there is also an effect of pressing the daughter board B toward the housing 10, thereby increasing the effectiveness of the locking piece 65*a* and thereby more effectively restraining the daughter board B. The pointed edge portion 65*d* is constituted by a burr edge to be formed when a metal plate is stamped. On the opposite side of the pointed edge portion 65*d,* there is a shear edge to be formed when the metal plate is stamped. For this reason, the pressure required when the pointed edge portion 65*d* enters in the inner wall of the semicircular recess B1 is increased, and the holding pressure of the daughter board B due to the daughter board locking piece 65*a* of the latch member 60 can be further increased. Further, the pointed edge portion 65*d* may be extendedly provided in parallel with the up-and-down direction or plate 61 instead of inclining along the up-and-down direction perpendicular to the horizontal direction. In this case, when a force is applied to the daughter board B in the horizontal direction, the pointed edge portion 65*d* comes into line-contact with the inner wall of the semicircular recess B1 to enter in, and the holding pressure of the daughter board B due to the daughter board locking piece 65*a* of the latch member 60 can be increased unlike a case where the holding pressure of the daughter board is obtained by the conventional area-contact. The daughter board locking piece 65*a* extends in a substantially opposite direction to the force in the horizontal direction for causing the daughter board B to be removed, thereby providing a significant opposing force.

The excessive movement preventing piece 65*c* is formed by bending the flat plate portion 61 on the outside inward from the lower end. The excessive movement preventing piece 65*c* prevents the daughter board B from excessively moving below when the daughter board B comes into contact with an elastic contact piece 67. Also, when the daughter board holding piece 65*b* is displaced on the outside to release the daughter board B, the excessive movement preventing piece 65*c* abuts against the inner side surface of the flat plate portion 62 to prevent the flat plate portion 61 from making an excessive displacement on the outside.

In this respect, an anti-over stress piece 66 provided on the flat plate portion 61 on the outside is located below the elastic contact piece 67. The anti-over stress piece 66 prevents the elastic contact piece 67 from being excessively warped below. Also, the anti-over stress piece 66 is located below the flat plate portion 62 on the inside and abuts against the lower edge of the flat plate portion 62 on the inside to prevent the flat plate portion 61 from lifting when the daughter board B held by the daughter board holder 65 is forced to be biased in the upward direction.

While the present invention has been described in connection with the illustrated embodiments, the present invention is not limited thereto, and it is appreciated and understood that modifications may be made without departing from the true spirit and scope of the invention. For example, the latch members 30A, 30B and 60 may be made of resin in place of metal. Also, when the latch members 30A, 30B and 60 are made of resin, they may be constituted separately from the housing, or may be constituted integrally with the housing as described in Japanese Patent Laid-Open No. 8-190967.

Further, when the latch members 30A, 30B and 60 are made of metal, at least daughter board locking pieces 47*a*, 65*a* may be coated with a resin member integral with or separate from the housing. A square edge made of a resin member may be arranged so as to enter in the inner wall of the semicircular recess B1 formed on the daughter board B. Thereby, the holding pressure of the daughter board B due to the daughter board locking piece 47*a*, 65*a* can be increased as compared with the conventional case, and removal of the daughter board B in the horizontal direction can be effectively restrained.

What is claimed is:

1. A card edge connector, comprising:

an insulated housing mounted onto a mother board;

a latch member attached to the housing, for holding a daughter board;

the latch member having a daughter board locking portion for restraining the daughter board from inadvertent removal in a horizontal direction by the latch member engaging with an inner wall of a semicircular recess formed at an edge portion of the daughter board;

the daughter board locking portion having a free end that has a pointed edge portion, the pointed edge portion inclined toward the housing engages the inner wall of said semicircular recess.

2. The card edge connector according to claim 1, wherein the pointed edge portion is inclined in a direction perpendicular to said horizontal direction, the pointed edge portion enters in the vicinity of a top end of the inner wall of said semicircular recess.

3. The card edge connector according to claim 1, wherein the locking portion is coated with a resin member.

4. The card edge connector according to claim 1, wherein the latch member is integral with the housing.

5. The card edge connector according to claim 1, wherein the locking portion is substantially U-shaped.

6. The card edge connector according to claim 1, wherein the latch member is bent from a front end of a flat plate portion extending from the housing.

7. The card edge connector according to claim 1, wherein the pointed edge portion is inclined so that a top end of the pointed edge portion engages a top edge of the inner wall.

8. The card edge connector according to claim 1, wherein the latch member is formed by stamping and forming a metal plate, and the pointed edge portion is a burr edge provided at a tip end of the latch member, the burr edge formed when said metal plate is stamped.

9. The card edge connector according to claim 8, wherein the locking portion includes a shear edge positioned opposite the burr edge.

10. A card edge connector, comprising:

an insulated housing mounted onto a mother board;

a latch member provided integrally with said housing, for holding a daughter board;

the latch member having a daughter board locking portion for restraining the daughter board from inadvertent removal in a horizontal direction by the latch member engaging with an inner wall of a semicircular recess formed at an edge portion of said daughter board, the locking portion is substantially curved and has a free end that extends toward the housing, the free end having a pointed edge portion for entering in the inner wall of said semicircular recess.

11. The card edge connector according to claim 10, wherein the latch member is made of resin.

12. The card edge connector according to claim 10, wherein the latch member is bent from a front end of a flat plate portion extending from the housing.

13. The card edge connector according to claim 10, wherein the pointed edge portion is inclined so that a top end of the pointed edge portion engages a top edge of the inner wall.

14. The card edge connector according to claim 10, wherein the pointed edge portion is a burr edge.

15. The card edge connector according to claim 14, wherein the locking portion includes a shear edge positioned opposite the burr edge.

16. A card edge connector, comprising:

an insulated housing mounted onto a mother board;

a latch member attached to the housing for holding a daughter board;

the latch member having a daughter board locking portion for restraining the daughter board from inadvertent removal in a horizontal direction, the locking portion having a first portion that extends away from the housing and a second portion that extends toward the housing, the second portion having a free end that engages an inner wall of a semicircular recess formed at an edge portion of the daughter board.

17. The card edge connector according to claim 16, wherein the free end has a pointed edge portion with a burr edge.

18. The card edge connector according to claim 16, wherein the free end is inclined so that a top end of the free end engages a top edge of the inner wall.

* * * * *